US007152349B1

(12) United States Patent
Rowlands

(10) Patent No.: US 7,152,349 B1
(45) Date of Patent: Dec. 26, 2006

(54) DRAGLINE BUCKET RIGGING AND CONTROL APPARATUS

(75) Inventor: Jeffrey C. Rowlands, Brisbane (AU)

(73) Assignee: CMTE Development Limited, Pinjarra Hills (AU)

( * ) Notice: Subject to any disclaimer, the term of this patent is extended or adjusted under 35 U.S.C. 154(b) by 0 days.

(21) Appl. No.: 10/182,023

(22) PCT Filed: Oct. 31, 2000

(86) PCT No.: PCT/AU00/01336

§ 371 (c)(1),
(2), (4) Date: Jul. 19, 2002

(87) PCT Pub. No.: WO01/32994

PCT Pub. Date: May 10, 2001

(30) Foreign Application Priority Data

| | | |
|---|---|---|
| Nov. 3, 1999 | (AU) | PQ3846 |
| Mar. 20, 2000 | (AU) | PQ6348 |
| May 10, 2000 | (AU) | PQ7400 |
| Sep. 12, 2000 | (AU) | PR0067 |

(51) Int. Cl.
*E02F 3/46* (2006.01)

(52) U.S. Cl. ..... 37/397; 37/396; 37/395

(58) Field of Classification Search ..... 701/35, 701/34, 50; 37/394, 395, 396–398, 399, 37/400, 401, 241–242, 248–252; 172/26.5; 405/288; 299/11

See application file for complete search history.

(56) References Cited

U.S. PATENT DOCUMENTS

| | | | | |
|---|---|---|---|---|
| 860,102 A | | 7/1907 | Newman | |
| 887,990 A | | 5/1908 | Weeks | |
| 945,547 A | | 1/1910 | Jones et al. | |
| 976,163 A | * | 11/1910 | Glaze | 37/401 |
| 1,093,887 A | | 4/1914 | Shnable | |
| 1,095,335 A | * | 5/1914 | Little | 37/395 |
| 1,097,029 A | | 5/1914 | King et al. | |
| 1,135,928 A | | 4/1915 | Roys | |
| 1,159,803 A | | 11/1915 | Sauerman | |
| 1,228,554 A | | 6/1917 | Hanot | |
| 1,236,691 A | * | 8/1917 | Dunlop | 37/395 |
| 1,242,320 A | | 10/1917 | Burkett | |
| 1,263,749 A | | 4/1918 | Dierks | |
| 1,289,395 A | | 12/1918 | Clutter | |
| 1,313,911 A | | 8/1919 | Potter | |
| 1,314,700 A | | 9/1919 | Potter | |
| 1,370,566 A | | 3/1921 | Thompson | |
| 1,406,725 A | | 2/1922 | Crawford | |

(Continued)

FOREIGN PATENT DOCUMENTS

| | | |
|---|---|---|
| AU | A-34502/89 | 6/1988 |

(Continued)

OTHER PUBLICATIONS

U.S. Appl. No. 29/162,591, filed Jun. 2002, Rowlands.

(Continued)

*Primary Examiner*—Raymond W. Addie
(74) *Attorney, Agent, or Firm*—Nixon & Vanderhye P.C.

(57) ABSTRACT

A large electric dragline having a housing (35) and boom (37) is provided with spaced apart in-line sheaves (34) and (36) at boom point to separate hoist ropes (31) and (32) which are led to the front and rear of bucket (30) respectively. Differential hoist rope control allows accurate and continuous adjustment of the bucket carry angle during all modes of operation. Also described is a computer control system giving continuous accurate control of carry angle by differential hoist rope operation, with manual selection of mode of operation.

33 Claims, 15 Drawing Sheets

U.S. PATENT DOCUMENTS

| | | | | | |
|---|---|---|---|---|---|
| 1,420,733 | A | | 6/1922 | Mundy et al. | |
| 1,589,907 | A | | 6/1926 | Smith | |
| 1,804,175 | A | | 5/1931 | Massey | |
| 1,999,681 | A | * | 4/1935 | Bakker | 37/394 |
| 2,120,444 | A | | 6/1938 | Smith | |
| 2,152,907 | A | | 4/1939 | Miller | |
| 2,158,061 | A | | 5/1939 | Atkins et al. | |
| 2,947,096 | A | | 8/1960 | Cummings et al. | |
| 2,952,083 | A | | 9/1960 | Forkner | |
| 3,605,987 | A | * | 9/1971 | Sigismondo | 198/509 |
| 3,908,838 | A | * | 9/1975 | Hanss | 198/509 |
| 4,035,621 | A | * | 7/1977 | Kemp | 701/35 |
| 4,035,936 | A | | 7/1977 | Avara | |
| 4,260,195 | A | * | 4/1981 | Hart | 299/11 |
| 4,370,713 | A | * | 1/1983 | McCoy et al. | 701/50 |
| 4,527,639 | A | | 7/1985 | Dickinson, III et al. | |
| 4,791,738 | A | | 12/1988 | Briscoe | |
| 5,084,990 | A | | 2/1992 | Briscoe | |
| 5,140,761 | A | | 8/1992 | Coffman et al. | |
| 5,400,530 | A | | 3/1995 | Schmidt | |
| 5,575,092 | A | * | 11/1996 | Smit | 37/398 |
| D392,983 | S | * | 3/1998 | Watts | D15/32 |
| 5,992,061 | A | | 11/1999 | Fleck et al. | |
| 6,446,366 | B1 | | 9/2002 | Briscoe et al. | |
| 6,550,163 | B1 | | 4/2003 | Briscoe et al. | |
| 2003/0126771 | A1 | | 7/2003 | Briscoe et al. | |

FOREIGN PATENT DOCUMENTS

| | | |
|---|---|---|
| SU | 606945 | 4/1978 |
| SU | 972008 | 11/1982 |
| SU | 1247471 | 7/1986 |
| SU | 1283303 | 1/1987 |
| WO | WO 85/04916 | 11/1985 |

OTHER PUBLICATIONS

International Search Report dated Jan. 10, 2001. International Appln. No. PCT/AU00/01336, filed Nov. 3, 1999.

ESCO Production Master Dragline Buckets, Orientation Manual for Dragline Operators, 13 PGS., Aug. 1993.

International Preliminary Examination Report PCT/AU00/01336 dated Sep. 21, 2001.

* cited by examiner

FIG. 7A
PRIOR ART
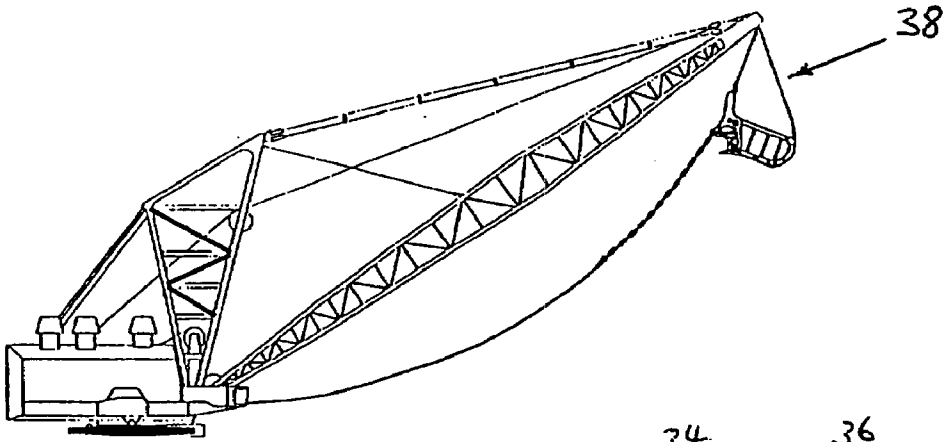
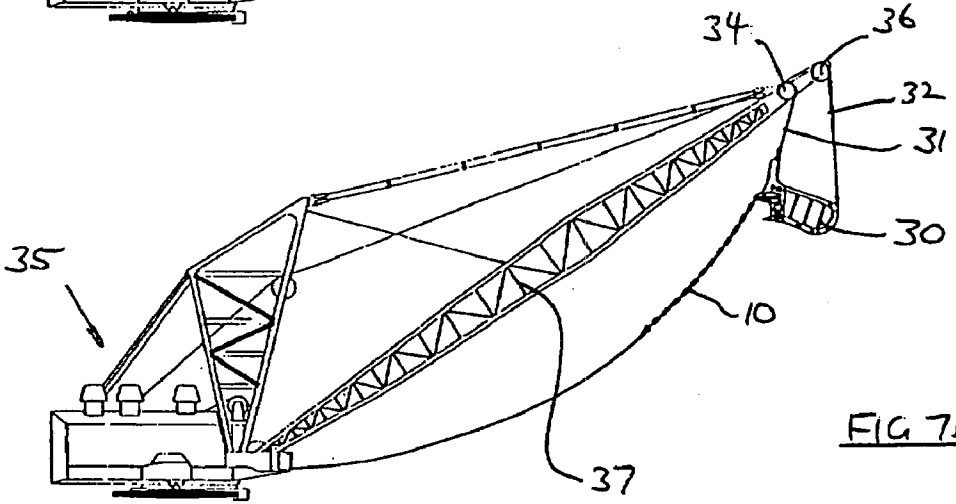
FIG. 7B

DRAGLINE BUCKET RIGGING AND CONTROL APPARATUS

FIELD OF THE INVENTION

This invention relates to a system for suspending and controlling a dragline bucket.

BACKGROUND ART

Draglines are large excavating machines designed to fill, carry and dump loads of material, typically earth. Draglines are often used in open cut coal mines to remove waste overburden covering a shallow coal seam.

FIG. 1 illustrates a typical large electric dragline in accordance with the prior art. A conventional dragline includes a rotatable support 1 mounted on a stationary base 2. An outwardly projecting boom assembly 3 is mounted pivotally to the rotatable support. Winches 6, 9 are mounted on the support for retrieving or releasing cables or ropes. Normally there are two main sets of ropes or cables, hereinafter referred to as hoist ropes 4 and drag ropes 5. Hoist ropes 4 extend from the hoist winch 6 mounted on the support, up and outwardly along the boom, over pulleys or sheaves 7 mounted at the most distant point of the boom, down to a bucket and rigging assembly 8. Drag ropes 5 extend from a drag winch 9 mounted on the support 1, outwardly to the bucket and rigging assembly 8. The bucket and rigging assembly consists of the bucket itself, and the "Rigging" which refers to the total collection of chains, ropes, cables and other components used to suspend the bucket.

A conventional dragline is equipped with a mechanism for locomotion, typically being reciprocating support feet or crawler tracks.

FIG. 2 shows the typical components of the bucket and rigging assembly in accordance with the prior art. While it is acknowledged that there are variations on the arrangements and names of components, the following definitions, familiar to any person skilled in the art, will be used:

Drag ropes 5 which are used to pull the bucket while filling (normally two).

Drag chains 10 which connect the drag ropes to the bucket.

Hoist ropes 4 which are used to lift and carry the bucket (normally two).

Hoist chains 11 (upper and lower) which connect the bucket to the hoist ropes.

Spreader bar 12 which separates the left and right hoist chains to allow the bucket to sit between. It is situated at the junction of the upper and lower hoist chains.

Dump rope 13 that allows the bucket to be picked up or dumped by applying or releasing tension to the drag ropes.

Dump block 14 which is a pulley around which the dump rope is free to move.

Dump chains 15 which are intermediate chains connecting the dump rope to the leading end of the drag chains.

Miracle hitch 16 which is a three way link that connects the hoist ropes, chains and dump block.

Drag three way link 17 that joins the drag ropes, drag chains and dump chains.

Equaliser links 18 that equalise the loads between various components and allow interconnection, e.g., from the two hoist ropes to the single miracle hitch.

Rope sockets 19 that are used to terminate ropes and allow their connection to other components.

Teeth and lip assembly 20 which is the leading (cutting) edge of the bucket.

Basket 21 which is the main body of the bucket used to carry payload.

Arch 22 which provides structural integrity to the bucket and supplies a point to attach the dump rope.

Dump hitch 23 which is the point on the ash to which the dump rope is attached.

Drag hitches 24 which are the points on the front of the bucket to which the drag chains are connected.

Hoist trunnions 25 which are the points to which the lower hoist chains are attached to the bucket.

Top rails 26 which are structural thickeners along the top edges of the bucket.

Rear rail 27 which is a structural thickener along the top edge of the rear of the bucket.

Other relevant definitions are:

"Carry Angle" which is the acute angle between the floor of the bucket and the horizontal.

"Rated Suspended Load" (RSL) which is the maximum recommended load that can be suspended from the hoist ropes.

"Boom Point" which is the most distant extreme of the boom 3 from the support 1. This point corresponds to the location of the Boom Point Sheaves 7.

"Boom Point Radius" which is the horizontal radius measured outwardly from the centre of rotation of the support 1 to a point directly under the boom point sheaves 7.

The drag and hoist ropes may be retrieved or released from their respective winches to move the bucket freely in space. The rotatable support can "Swing" the upper dragline assembly and thus bucket and rigging through a horizontal arc.

The normal operation of a dragline begins with the bucket freely suspended in space above the ground. The bucket is then lowered to the ground and positioned by releasing rope from the hoist winch and/or drag winch. The bucket is then filled with material by retrieving drag ropes onto the drag winch. At some point, the bucket may be lifted or "Disengaged" from the ground by retrieving the hoist ropes. In this operation, tension is developed in the dump rope 13 which causes the front of the bucket to lift via the arch 22. A certain volume of excavated material known as "Payload" is retained in the bucket after disengaging. The bucket may then be moved to its dump point by retrieving and releasing the hoist and drag ropes and/or swinging the support 1. The payload is dumped by releasing drag rope until the dump rope loses tension and allows the bucket to tip forward. This operation can only occur under, or nearly under the boom point sheaves.

For a typical large electric dragline (e.g. BE 1370W or Marion 8050), the bucket capacity is approximately 47 cubic meters. The bucket weight is typically 40 tonnes. The combined rigging weight is typically 20 tonnes. The RSL for these machines is approximately 150 tonnes. Therefore, the manufacturers recommend payloads of approximately 90 tonnes.

There are a number of limitations that conventional rigging designs place on operating a dragline.

a) After filling the bucket, it cannot be disengaged from the ground until the bucket is sufficiently close to the support 1 to allow enough tension to be developed in the dump rope to lift the bucket arch. FIG. 3 shows that if the bucket is lifted too early, the forward section of the payload is lost. This means that the bucket must be "Over-dragged" after it is full, to a point where it can be lifted and retain a satisfactory payload. This adds to cycle time, increases wear and reduces hoisting efficiency.

b) A dragline bucket can only dump at the perimeter defined by the boom point radius. This is because the dump rope will only become slack enough to drop the front of the bucket when the drag rope tension is low, i.e., the drag ropes have been sufficiently released. FIG. 4 shows this effect. There are dynamic methods for dumping just inside and outside of boom point radius, however these methods are not recommended by the manufacturers.

When a bucket is being carried, its carry angle is determined by two main factors: (i) the bucket position with respect to the boom, and (ii) the length of the dump rope. The payload retained in the bucket depends heavily on the carry angle—too shallow and the payload front section is lost,—too steep and the top-rear section is lost. This effect is shown in FIG. 5.

Various proposals have been made to improve the control of the orientation of the dragline bucket in a vertical plane i.e. "carry angle" control by utilising differential control of the two hoist ropes, one of which is operatively connected to the front of the bucket, and the other operatively connected to the rear of the bucket. By adjusting the position of one hoist rope relative to the other, the vertical orientation of the bucket can be adjusted in order to provide a dumping movement without relying on the dump rope becoming slack with all of the disadvantages set out above. Constructions of this type have been proposed in Australian Patent Application 34502/89 ("Beatty") and in Russian Patent Specifications 972008 and 606945. In both the Beatty and the Russian '008 specifications the carry angle of the bucket is controlled by differential hoist rope movement with the hoist rope entrained over side by side boom point sheaves on a common axis, as is commonly used in dragline construction Beatty, in FIG. 7, shows a construction where the rear hoist rope 63*d* can be shortened relative to the front hoist rope 63*c* by using a sheave 58*a* forced sideways against hoist rope 63*d* by hydraulic ram 57*a* to move the bucket from a carrying to a dumping or chopping mode.

Both Beatty and Russian '008 have the disadvantage that they retain a significant number of conventional rigging components such as spreader bars and hoist trunnions, that due to their combined weight, limit the maximum payload that can be carried without exceeding the manufacturers RSL. Furthermore, by positioning the boom point sheaves side by side in the conventional manner, increased loads are placed on the hoist ropes as the bucket is raised to a position approaching the boom due to triangulation between the hoist ropes and the bucket from the spacing apart of the hoist rope attachment points on the bucket. This limits the freedom of movement of the bucket relative to the boom and also causes the bucket carry angle to vary significantly as the drag ropes are retrieved or paid out.

Russian specification 606945 describes an excavator having the bucket suspended by hoist ropes attached to the front and rear of the bucket respectively, and wherein a mechanism is provided at the boom point operable to move the boom point sheave of the rear hoist rope outwardly, shortening the vertical scope of the rear hoist rope relative to that of the front hoist rope to move the bucket from a digging or carrying orientation to a dumping orientation. This configuration has the disadvantage of providing additional complication and significantly increased weight at the boom point, which would significantly reduce the RSL of the excavator. When the bucket is held in the normal carry or dig modes, the sheaves are close together and the problem of increased loads from triangulation is present as for Beatty and Russian '008 (see FIG. 1 of Russian '945). Furthermore, the method proposed in Russian '945 is completely unsuited for use with large electric dragline as the weight of the mechanism at boom point would result on unacceptable loadings on the boom and an unacceptable increase in rotational inertia of the boom and housing assembly when the housing is pivoted in its base for dumping or other similar operations. It is also believed that the mechanism in Russian '945 is totally inapplicable to a large electric dragline as the force required to be developed by the hydraulic ram at boom point would not be available from any known hydraulic ram system.

It has also been proposed at various times to use a computer to control some of the operations of a dragline for various purposes such as the accurate positioning of the dump position over a hopper for the discharging of the bucket load onto a conveyor. Control of this type has been proposed in Australian patent application 87303/77 ("Mitsubishi") and 28179/84 (Winders, Barlow and Morrison; "WBM").

Both the Mitsubishi and WBM patent specifications describe the use of a computer to accurately control the transition of the dragline from one mode to another. They are particularly concerned with accurately swinging the dragline from an orientation used for the digging operation to a second orientation used for dumping, and to accurately control the dumping point to ensure that the pay load can be dumped into a hopper strategically placed on a conveyer belt for the removal of material from the area. In this sense, both Mitsubishi and WBM improve the accuracy of the operator by imposing computer controlled parameters at the change over from one mode of operation to the other, but they do not enhance the overall operating efficiency of the dragline by enabling accurate control of the carry angle of the bucket, particularly in the digging, carrying, and cleaning modes.

It is therefore an object of the preset invention to provide dragline bucket rigging and control apparatus which will obviate or minimise some or all of the foregoing disadvantages in a simple yet effective manner or which will at least provide a useful choice.

SUMMARY OF THE INVENTION

Accordingly, in one aspect the present invention provides a rigging configuration for a dragline having a rotatable support mounted on a base, a boom assembly projecting outwardly from the support and rotatable therewith, and a bucket suspended from the boom assembly by adjustable hoist ropes and controllable by adjustable drag ropes extending from the support to the bucket, the rigging configuration providing at least two boom point sheaves located at or adjacent the distal end of the boom assembly and spaced apart from each other by a fixed distance such that the first said sheave is located closer to the support than the second said sheave, two hoist ropes entrained over the boom point sheaves, one to each, the first said hoist rope being entrained over the first sheave, extending downwardly and being operatively connected to a front section of the bucket, the second said hoist rope being entrained over the second sheave, extending downwardly and being operatively connected to a rear section of the bucket, and at least one drag rope extending from the support and being operatively connected to a font section of the bucket.

Preferably the first and second sheaves are spaced apart by a fixed distance of a similar order to the spacing of the operative connections of the fist and second hoist ropes to the bucket.

Preferably, the first and second sheaves lie substantially in the same vertical plane.

In a further aspect, the present invention provides a dragline having a rigging configuration as described in the SUMMARY OF THE INVENTION above, and further incorporating differential control for hoist rope payout and retrieval, arranged such that the length of one said hoist rope may be adjusted relative to the other to control the angle of inclination of the bucket in a vertical plane.

In a still further aspect, the present invention provides a control system for a dragline of the type having a rotatable support mounted on a base, a boom assembly projecting outwardly from the support and rotatable therewith, and a bucket suspended from the boom assembly by adjustable hoist ropes and controllable by adjustable drag ropes extending from the support to the bucket, therebeing at least two adjustable hoist ropes of which the first is operatively connected to a front section of the bucket and the second is operatively connected to a rear section of the bucket, each hoist rope being actuated by hoisting gear arranged to alter the angle of inclination of the bucket in a vertical plane by differential movement of one hoist rope relative to the other, the control system using a computer to control the relative movement of the first and second hoist ropes via the hoisting gear, to maintain the bucket in a desired angle of inclination for a mode of dragline operation selected by an operator.

Preferably, in one or more of the selected modes of operation, the computer controls the desired angle of operation continuously throughout that mode.

Preferably the computer is used to limit the rates of dynamic transition that the hoisting gear may apply.

Preferably the control system is arranged to allow the operator to control movement of the bucket relative to the boom assembly and housing within preset safe operating parameters.

Preferably the modes of dragline operation selected by the operator can include any one or more of chopping, digging, disengaging, carrying, dumping and cleaning modes.

BRIEF DESCRIPTION OF THE DRAWINGS

Notwithstanding any other forms that may full within its scope, one preferred form of the invention will now be described with reference to the accompanying drawings in which:

FIGS. 7A–B illustrate conventional boom point sheaves and boom point sheaves according to an embodiment of the invention.

BEST MODE

Figure 1:
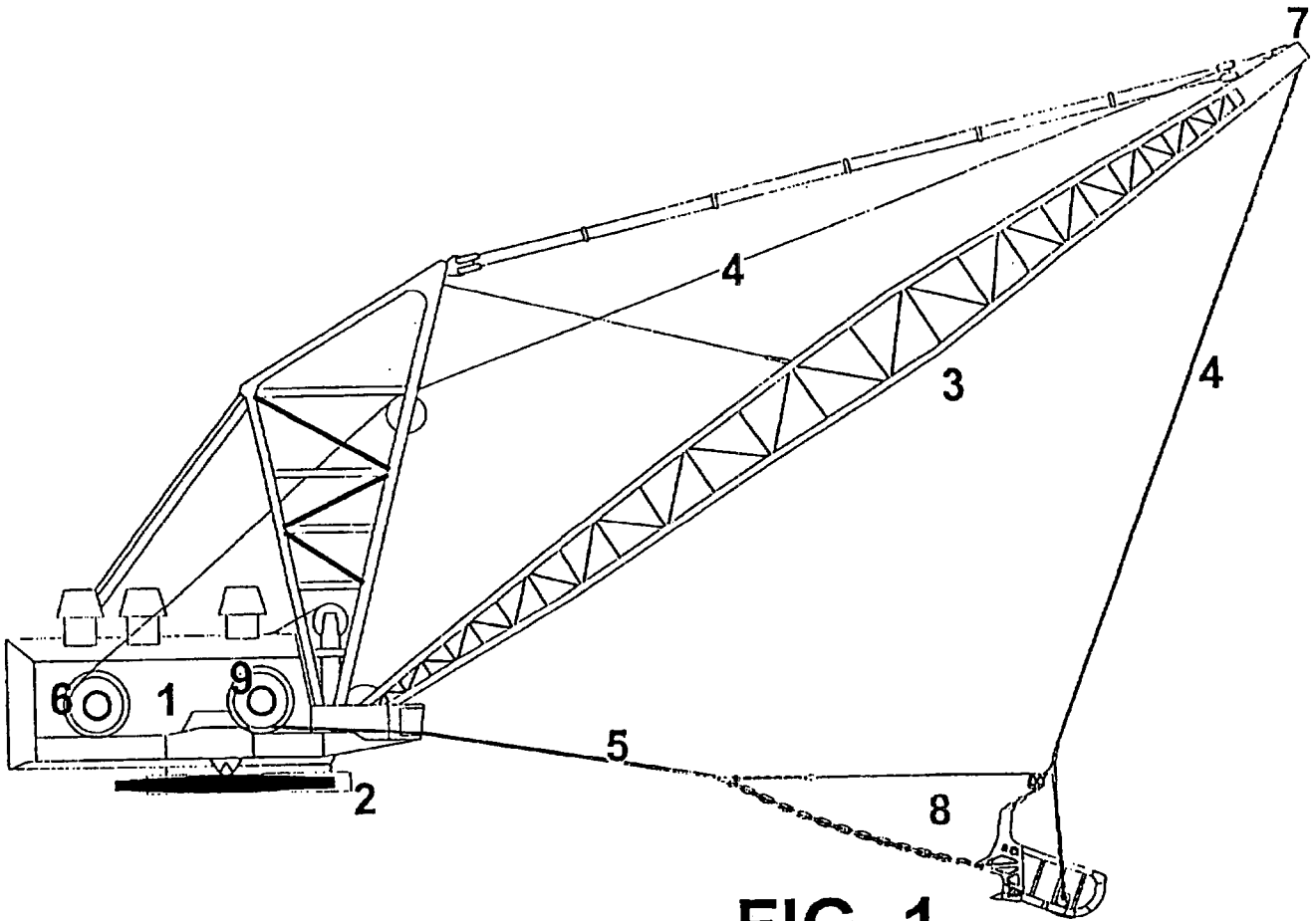
FIG. 1 PRIOR ART
FIG. 1 illustrates a conventional dragline.
Figure 2:
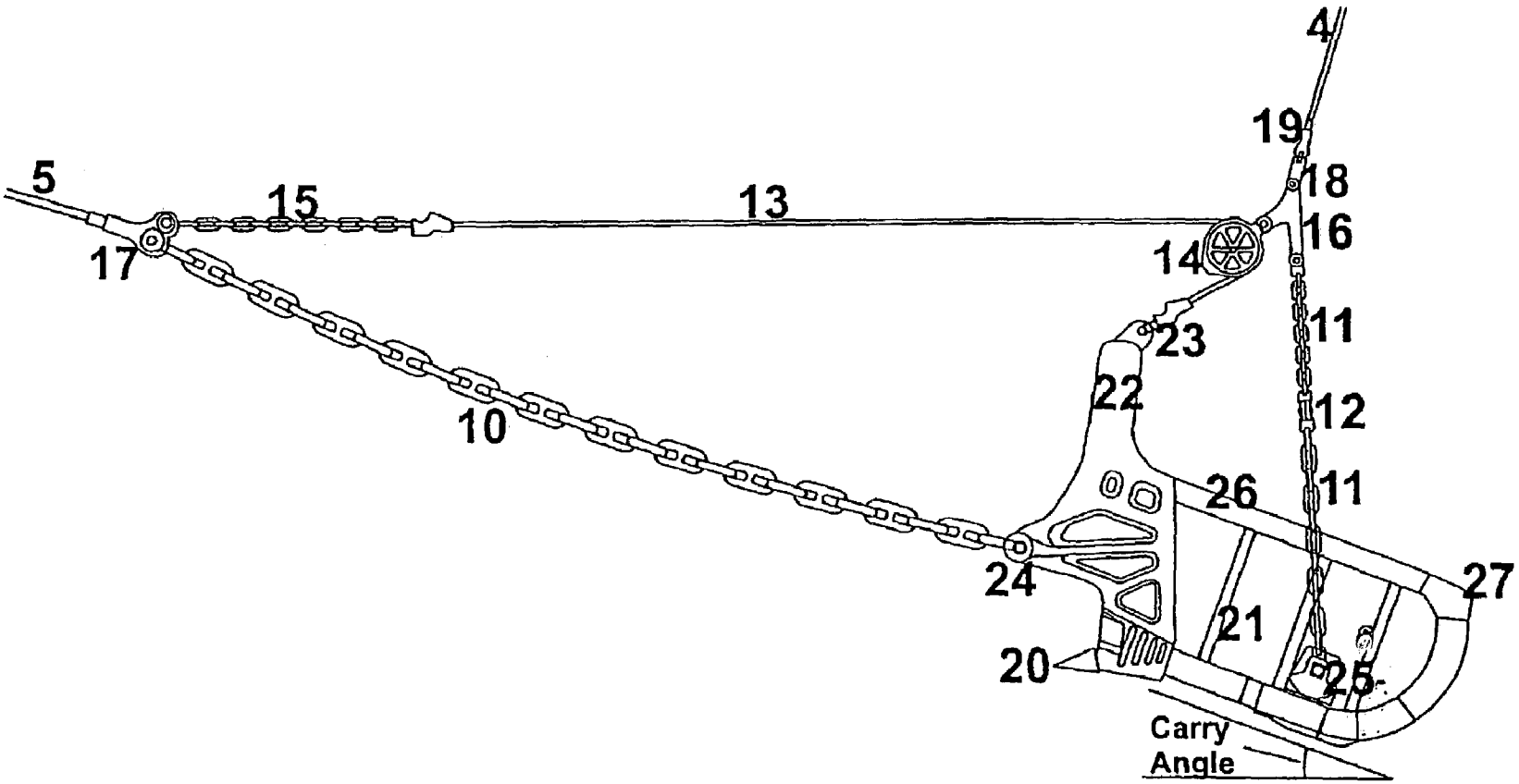
FIG. 2 PRIOR ART
FIG. 2 illustrates conventional components of a bucket and rigging assembly.
Figure 3:
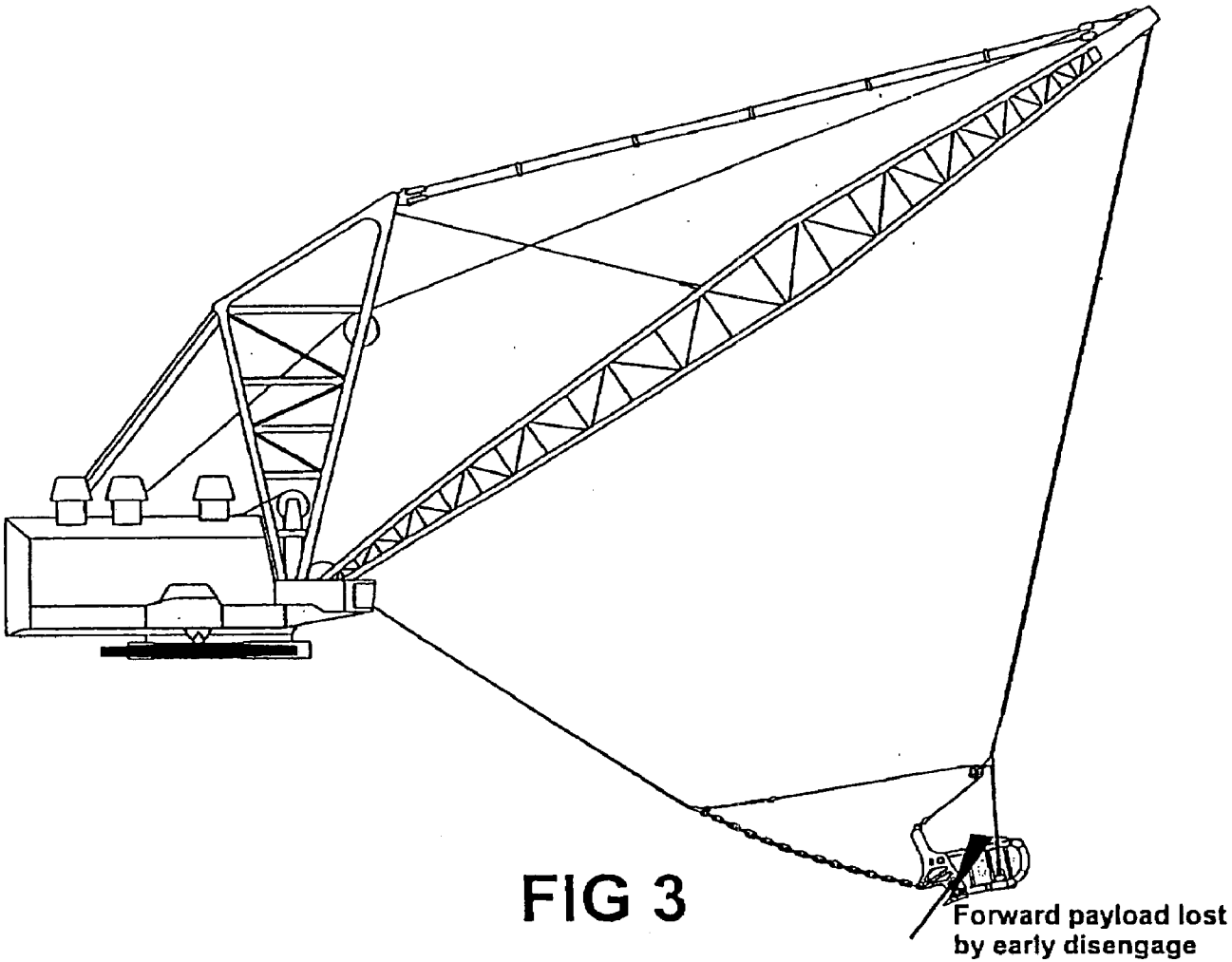
FIG 3 PRIOR ART
FIG. 3 illustrates a disadvantage with a conventional dragline.
Figure 4:
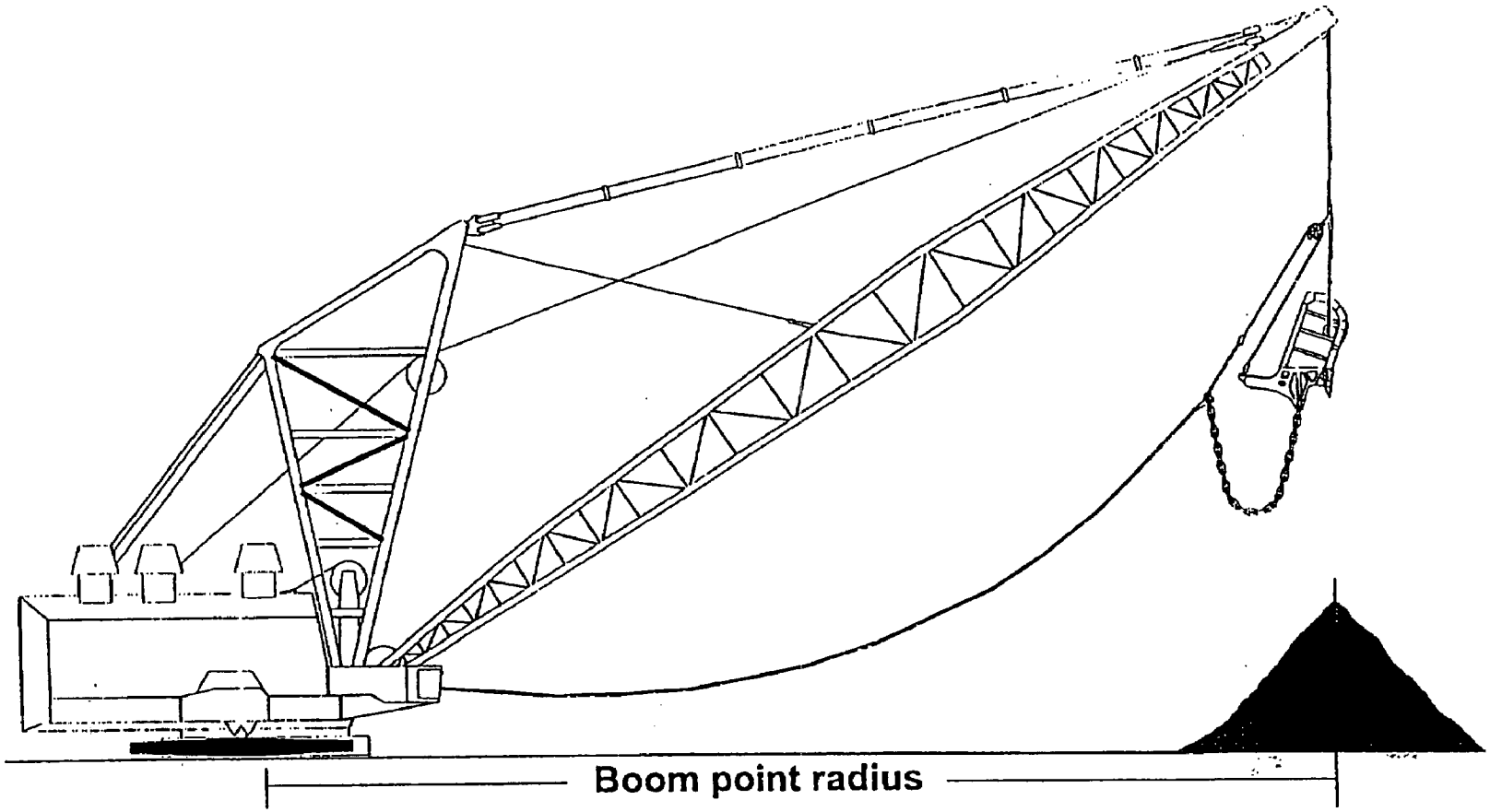
FIG. 4 PRIOR ART
FIG. 4 illustrates a conventional dragline dumping at the boom point radius.
Figure 5:
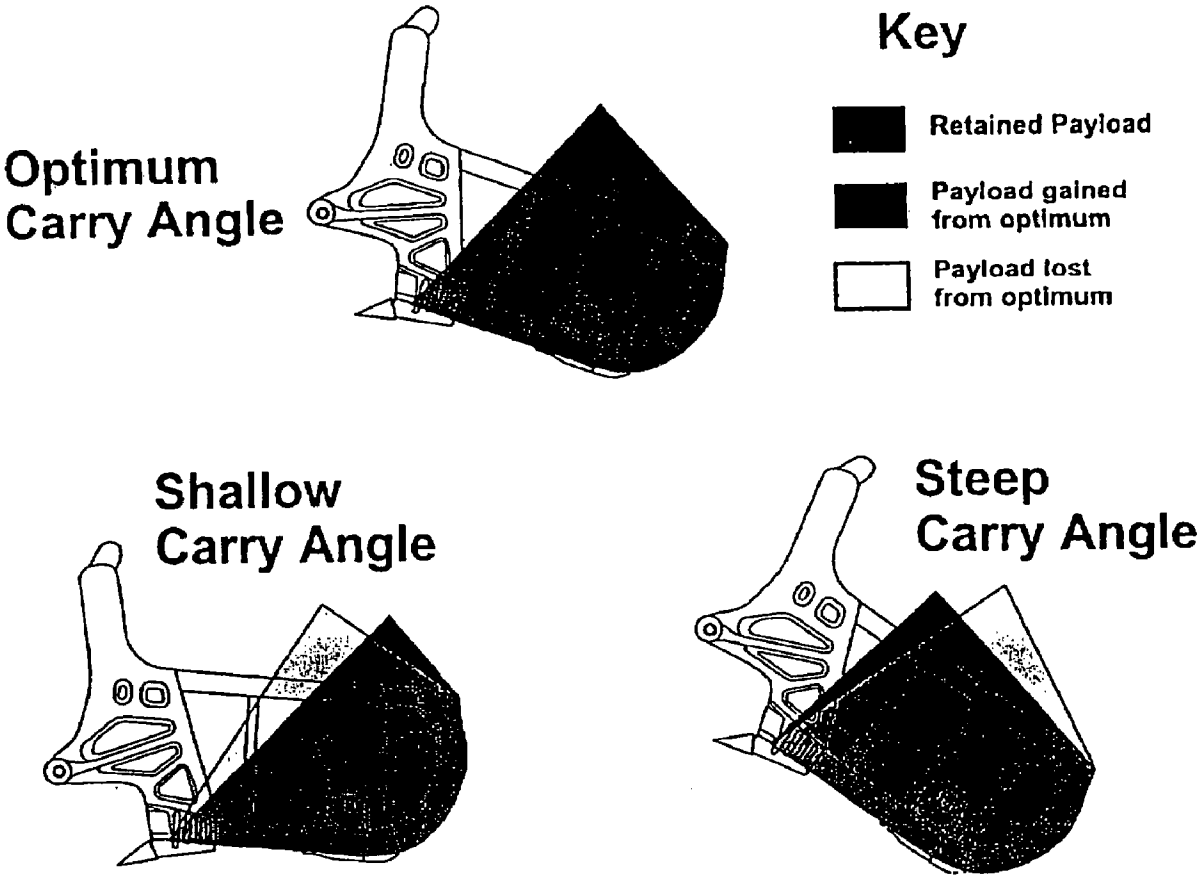
FIG. 5 PRIOR ART
FIG. 5 illustrates a bucket at the optimum carry angle, a shallow carry angle and a steep carry angle.
Figure 6A:
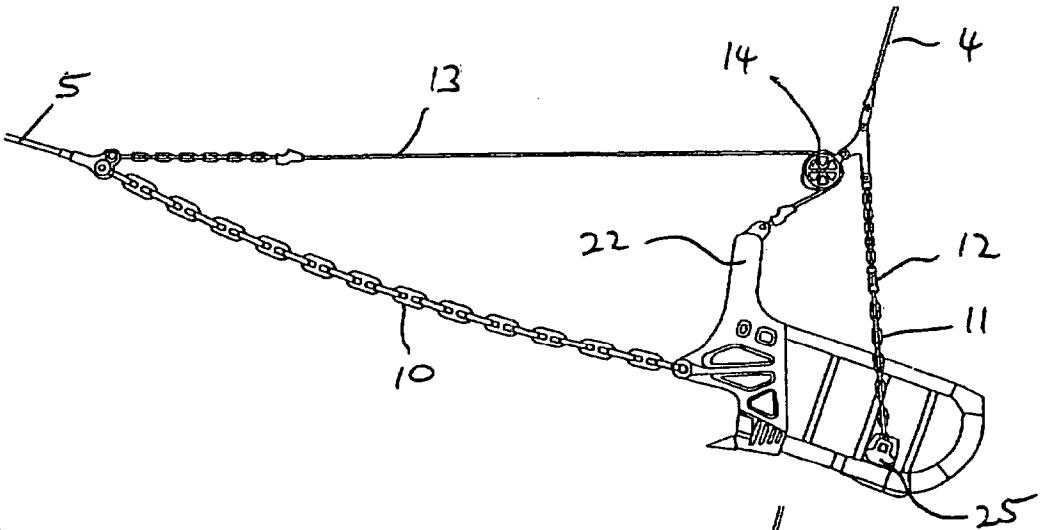
FIG. 6A PRIOR ART
FIGS. 6A–B illustrate a conventional rigging configuration, and a rigging configuration according to an embodiment of the invention.
Figure 6B:
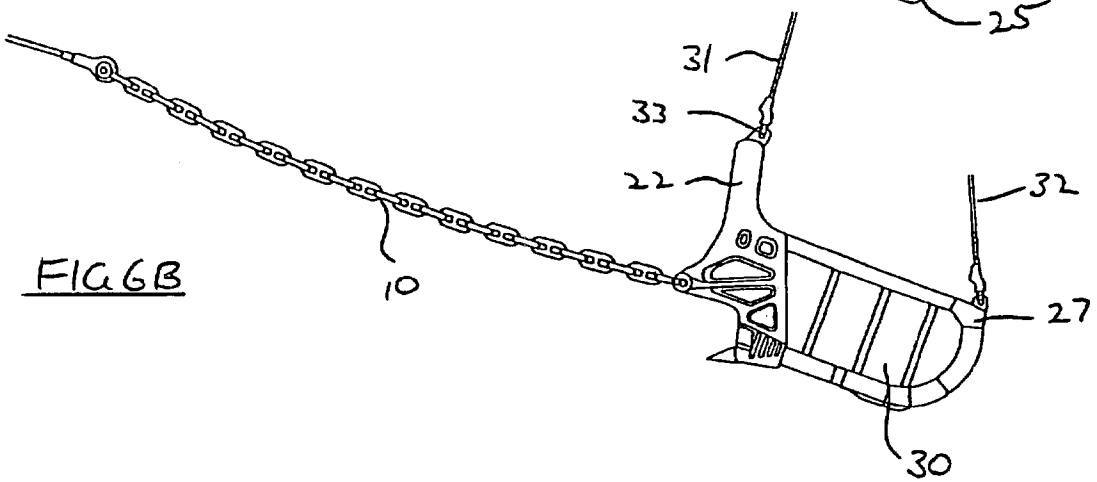

The invention includes a system for controlling the carry angle of the bucket by directly suspending the bucket 30 (FIG. 6B) from two hoist ropes 31 and 32. The first hoist rope 31 is connected to a forward section of the bucket. For a conventional bucket, the connection point 33 may be on the arch 22 at or near the normal dump rope hitch point (shown in FIG. 6A). Other methods for connection to a forward section of the bucket are possible including intermediate cables, ropes or chains that directly connect to a forward section of the basket. The second hoist rope 32 is connected directly to the directly connect to any rearward point on the bucket, without the use of heavy rigging such as the hoist chains 11, spreader bar 12, or hoist trunnions 25 (FIG. 6A).

The carry angle of the bucket is altered by differentially shortening or lengthening one hoist rope with respect to the other. By directly connecting the hoist ropes to the bucket, many conventional rigging components can be eliminated. The weight of these components can be replaced by increasing the bucket payload without exceeding the RSL of the dragline. This is an improvement over the system described in Australian Patent specifications 34502189, 38089/78 or 28179/84, where the rear hoist rope is connected to the conventional hoist trunnions which therefore requires the use of conventional hoist chains, spreader bar, hoist trunnions, and associated deflector shields.

Another aspect of the invention is the repositioning of the conventional boom point sheaves in such a way as to minimise twisting of the bucket and excessive rope loads when the bucket is situated in close proximity to the boom and/or boom point sheaves. FIG. 7A shows the conventional side by side arrangement of the boom point sheaves while FIG. 7B shows how the two sheaves are repositioned a fixed distance apart according to the invention, one behind the other instead of side by side to achieve this aim. It is preferred to space the two sheaves by a distance of a similar order to, and most preferably approximately equal to, the spacing of the operative connections of the first and second hoist ropes to the bucket. The first sheave 34 is located closer to the support 35 than the second sheave 36 which is located at the extreme or distal end of the boom 37. The first hoist rope 31 is entrained over the first sheave 34, extending downwardly and being operatively connected to a front section of the bucket as previously described with reference to FIG. 6B. The second hoist rope 32 is entrained over the second sheave 36, extending downwardly and being operatively connected to a rear section of the bucket 30.

It is preferred, although not essential that the first and second sheaves each have a medial plane extending from the raid point of the sheave perpendicular to the a of rotation of that sheave, and that the medial planes of the first and second sheaves lie substantially in a common vertical plane. Locating the sheaves in the same vertical plane, automatically aligns the mid line of the bucket 30 with that of the boom 37 while the spacing apart of the two boom point sheaves 34 and 36 keeps the bucket from twisting or slewing during operations.

It is a further advantage of separating the boom point sheaves as shown in FIG. 7B that the "triangulation" between the two hoist ropes 31 and 32 and the bucket which results from positioning the boom point sheaves side by side and can be clearly seen at 38 in FIG. 7A, is eliminated or reduced. The triangulation causes significantly increased loads in the front hoist rope as the bucket approaches the boom as seen in FIG. 7A which will either result in overloading of the hoist ropes and reduction in rope life, or in a reduction of the pay load able to be carried within the bucket.

Figure 14A:
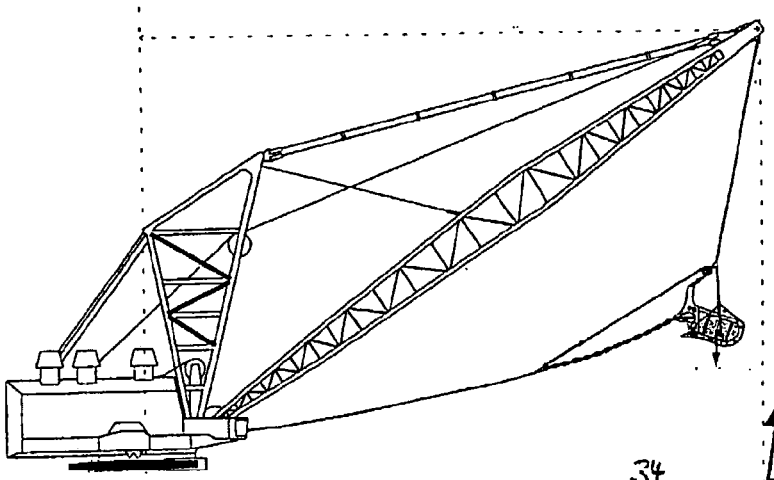
FIG 14A PRIOR ART
FIG. 14 illustrates the hoist force resultant line of action for one embodiment of the invention and that of conventional side by side boom point sheaves.
Figure 14B:
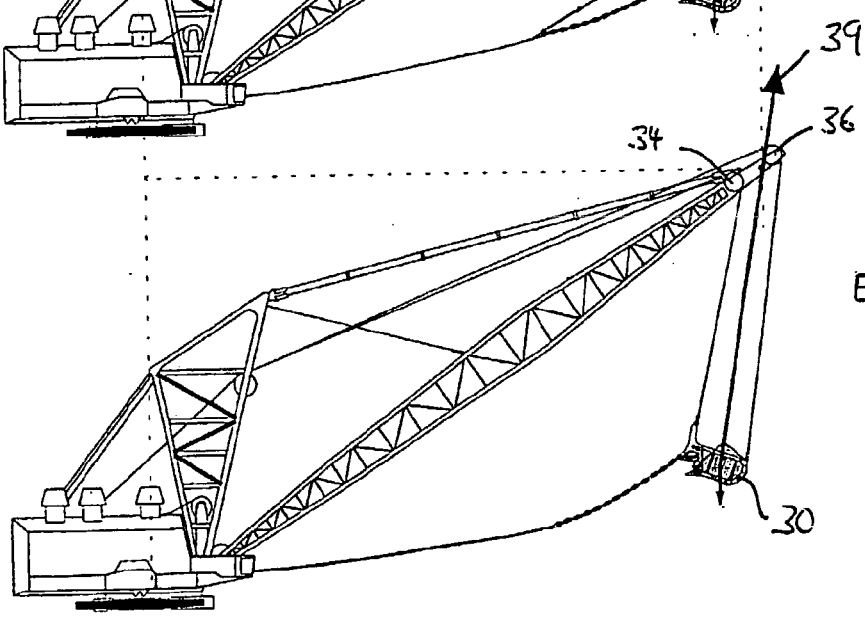
Figure 15:
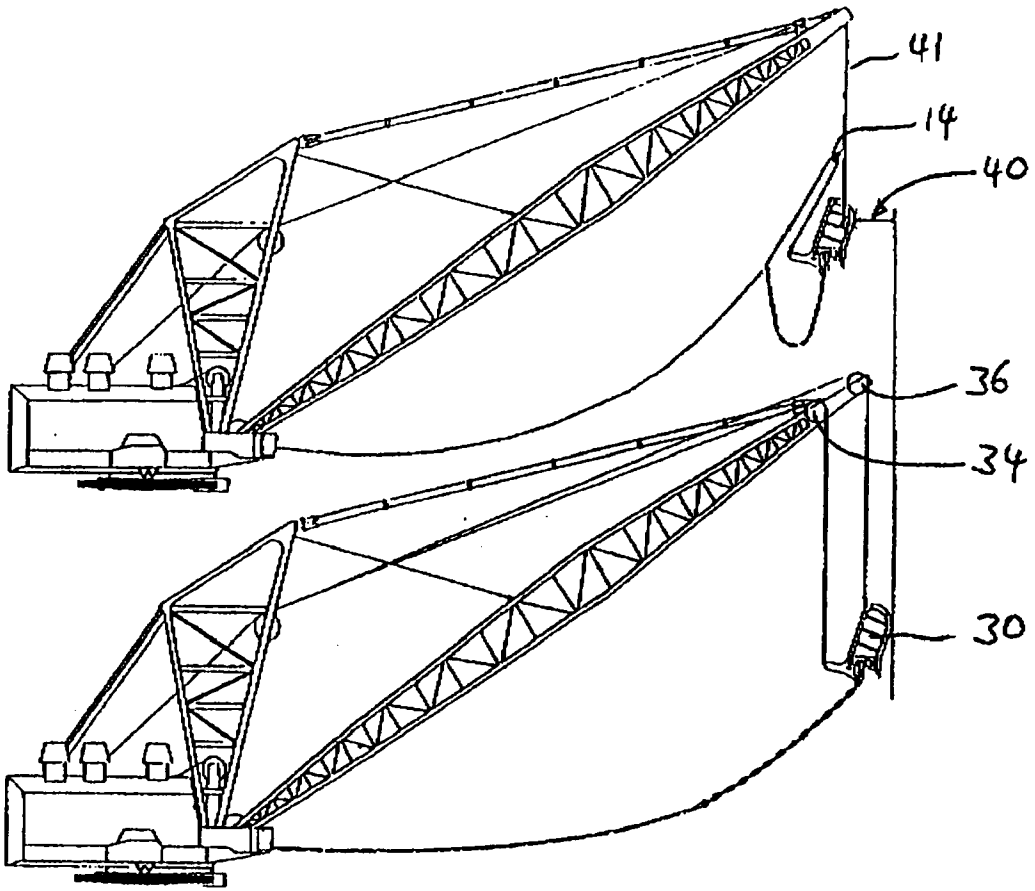
FIG. 15 illustrates the increase in reach due to one embodiment of the invention.

Another advantage of repositioning the boom point sheaves in line, one behind the other, is an increase in effective reach of the dragline for chopping or dumping. The load on the boom is not altered from the conventional side by side configuration by virtue of maintaining the same resultant line of action for the total hoist load. FIG. 14B shows that the resultant line of action 39 for the hoist load in the configuration according to the invention intersects the boom at the same position as for the conventional side by side configuration shown in FIG. 14A, when carrying a full payload. However, when the bucket is positioned for chopping as in FIG. 15, the effective reach of the machine is increased by distance 40, which is approximately 5 meters for a 100 meter long boom. This increase in reach does not harm the dragline since the bucket is empty at this point and is therefore in a low load scenario. The increase in reach significantly improves the efficiency of operation of the dragline as would be understood by any person skilled in the art. The reach is further enhanced by a reduction in the drag rope tension that would normally pull the empty bucket back towards the cents of the machine. This reduction occurs due to the elimination of the intermediate connection 14 of the drag rope to the conventional dump rope.

Another advantage of repositioning the boom point sheaves one behind the other is the reduction in adjustment needed between the lengths of the two hoist ropes to maintain a constant carry angle during movement of the bucket forwards or backwards under the vertical plane of the boom due to the semi-parallelogram configuration seen in FIG. 7B as opposed to the triangular configuration of FIG. 7A.

These advantages are achieved without any significant increase in boom point weight as the components used in conventional draglines are simply repositioned (one sheave moved out and the other back). There is therefore no significant reduction in RSL or increase in the rotational inertia of the housing and boom assembly which would affect the peak loads and cycle time during slewing movement.

Due to the dynamic nature of the operational modes of a dragline, one or both hoist ropes may develop excess slack in the invention. This slack must be quickly eliminated to ensure that the ropes correctly spool onto the hoist winch drum.

The slack may occur due to the elimination of the various conventional rigging components which formerly acted as dead weight and thus maintained overall tension in the hoist ropes. It may also occur due to the uncontrolled change of bucket carry angle during digging or during transition between operational modes.

Another aspect of the invention is to a method for controlling and eliminating this slack. This can be either a passive or active system. A passive system can use an independent rope loop take-up mechanism designed to maintain sufficient tension in one or both hoist ropes to allow the ropes to spool correctly. An active system can use sensors to determine the amount of slack rope in one or both ropes and can instruct the Central Control System to activate the main hoist rope adjustment mechanism to alter the length of either hoist rope accordingly to maintain sufficient rope tension for correct spooling.

Figure 11:
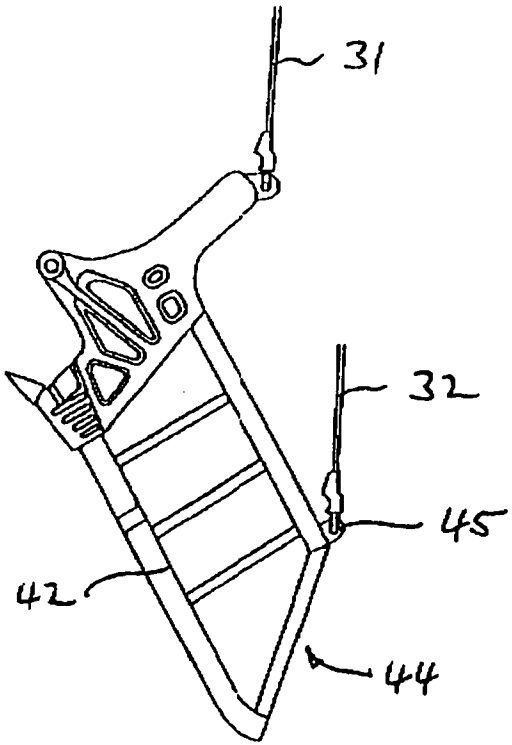
FIGS. 10 and 11 illustrate respectively, a forward and a rear dumping bucket according to an embodiment of the invention.
Figure 10:
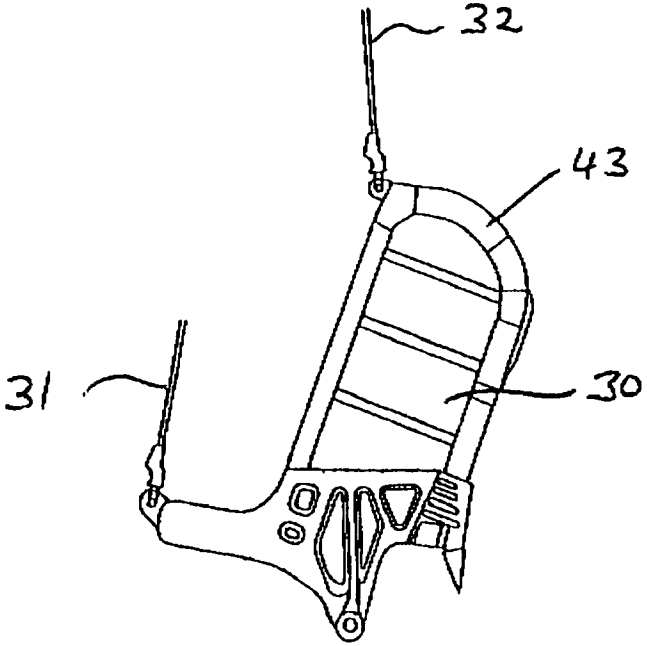

Another aspect of the invention can include the ability to dump out of the rear of a bucket. Because the invention allows the bucket carry angle to be changed to any angle by differential control of the hoist ropes 31 and 32, it is possible to design a bucket that has a low, or no rear wall that will allow payload to flow out in the opposite direction to a conventional bucket during dumping. The advantages of this configuration include a reduction in overall bucket mass which may be replaced by further payload increases, and an increase in dumping reach (or radius). FIG. 10 illustrates the bucket previously described for comparison with FIG. 11 showing a rear dumping configuration of the bucket 42.

In bucket 42, the rear wall 43 of the conventional bucket 30 is replaced by an open rear end 44 with the second hoist rope 32 suspended on a bridge 45 or similar across the open top of the rear portion of the bucket. In the rearward dumping configuration, to dump the pay load the second or rear hoist rope 32 is lengthened relative to the first or front hoist rope 31 to cause the bucket to tilt to the orientation shown in FIG. 11 as opposed to the opposite operation for a conventional bucket shown in FIG. 10.

Another aspect of the invention can include the ability to optimise the carry angle for chopping or dumping by moving the position of the rear hoist rope attachment point to different sites on the rear of the bucket. For a bucket of conventional design lowering the rope attachment position will cause the bucket to hang more steeply when positioned under boom point and visa versa. This ability can further increase the versatility of the invention by ensuring that appropriate carry angles for dumping and chopping can be easily achieved.

Figure 13:
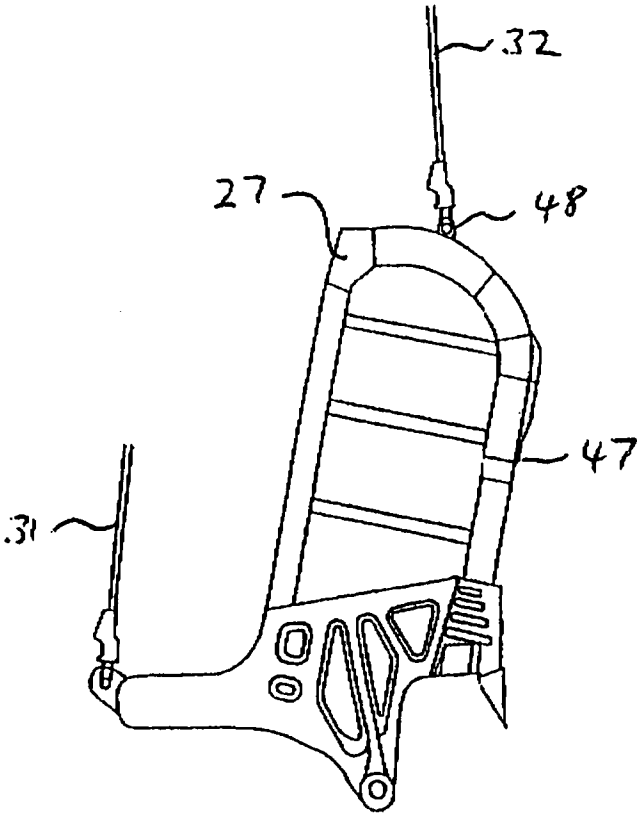
FIGS. 12 and 13 illustrate a bucket having the rear hoist rope ached to the rear of the bucket.
Figure 12:
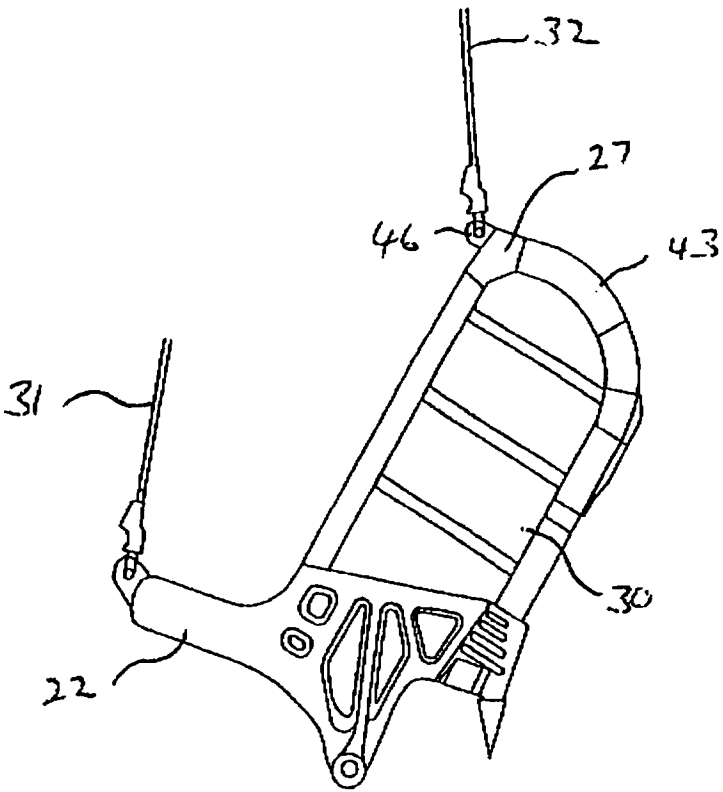

FIG. 12 shows a conventional bucket 30 with the rear hoist rope attachment point 46 at the level of the upper rear bucket rail 27. FIG. 13 shows that by moving the rear attachment point to a position 48 towards the floor 47 of the bucket, the dump or chop angle can be substantially increased by virtue of the alteration in static balance of the bucket. This also increases the dump or chop radius of the bucket.

Several mechanisms for differentially lengthening and shortening one hoist rope with respect to the other have been described in the prior art. These include separate winches, intermediate jockey wheels, split hoist drum assemblies and clutches.

In the preferred form of the invention the differential hoist rope control is provided by separate or split drums wherein one said hoist rope is wound on to a first drum located in the base or housing, and the other hoist rope is wound on to a second drum also located in the base or housing. The first and second drums are independently rotatable to achieve the differential control.

It is preferred to locate the first and second drums adjacent one another on a common axis with their inner ends adjacent one another, each being driven by a motor located respectively on the outer ends of the drums. Alternatively, it is possible to use a single drive motor with variable speed mechanisms or clutches to independently control rotation of the two drums.

In a further aspect the invention is directed to a system that enables accurate control of the independent rope adjustment mechanisms.

Figure 8:
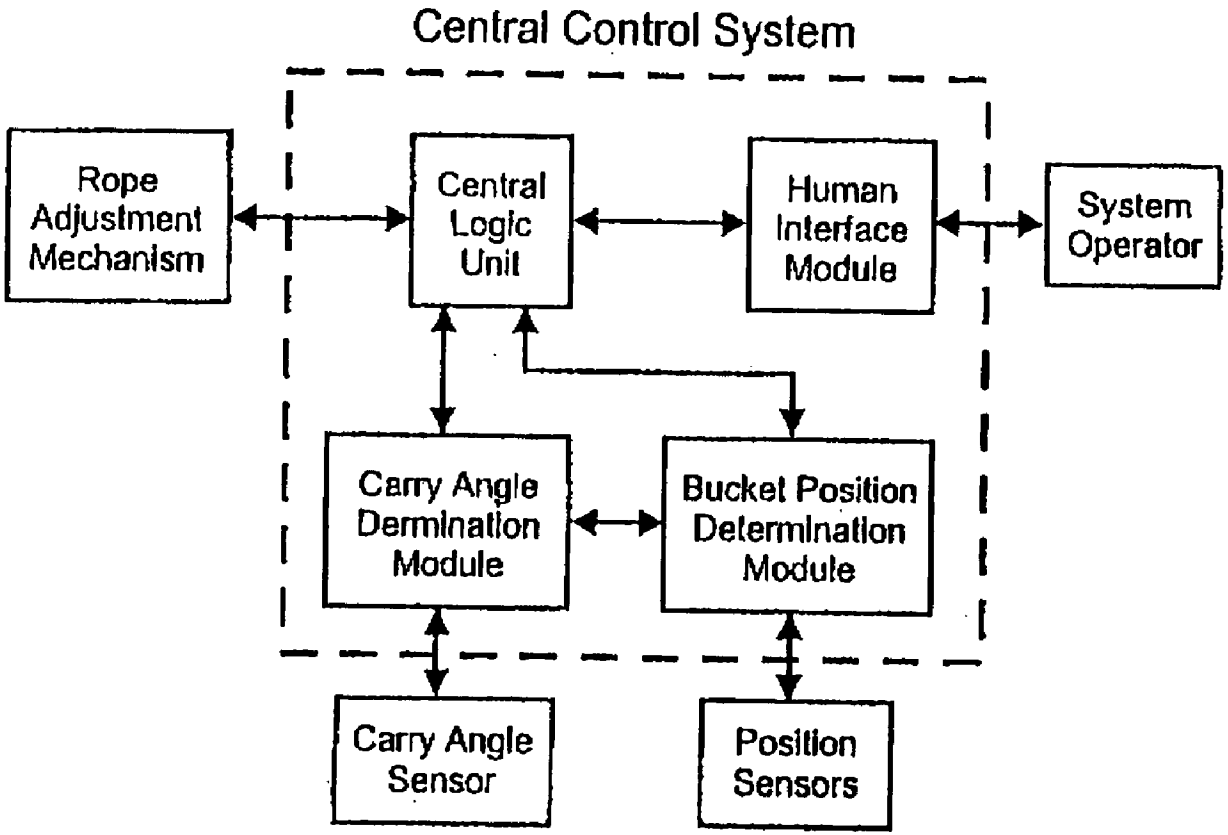
FIGS. 8 and 8A illustrate variations to a central control system according to an embodiment of the invention.

The invention may include a central control system or computer that allows the carry angle of the bucket to be varied to suit all aspects of dragline operations. The central control system is also designed to minimise risk to the operator and the dragline. The central control system uses empirical and analytical methods to determine and maintain the optimum carry angle at all times. The main duties of the central control system are:

a) Gather and store information as to the state of the bucket and rigging through direct or indirect sensors and trigonometric calculation algorithms b) Interface with a human operator c) Determine solutions to operational instructions within defined static and dynamic constraints d) Actuate and control the hoist rope adjustment system in a safe manner. FIG. 8 shows a schematic of the main components of the central control system. They include a central logic unit, a bucket carry angle determination module, a bucket position determination module, and an interface for a human operator.

The bucket position determination module may use information from positional sensors to determine the current lengths of the drag and hoist ropes and geometrically solve the position of the bucket with respect to the dragline structure. It may also use direct information from electronic distance measuring devices such as lasers to determine the bucket's position.

The carry angle module may use direct sensors such as electronic inclinometers mounted on the bucket to determine the current carry angle of the bucket. It may also use remote sensors such as laser scanners or radar to determine the angle. It may also use information from the bucket's position in conjunction with empirical or analytical methods to calculate the carry angle. The empirical method uses previously measured data to compare to the current bucket's position and determines what the current carry angle would be. This is commonly referred to as a "Look-Up Table". The analytical method determines the carry angle based on the current bucket position using well understood trigonometric and kinematic calculation techniques.

Figure 8A:
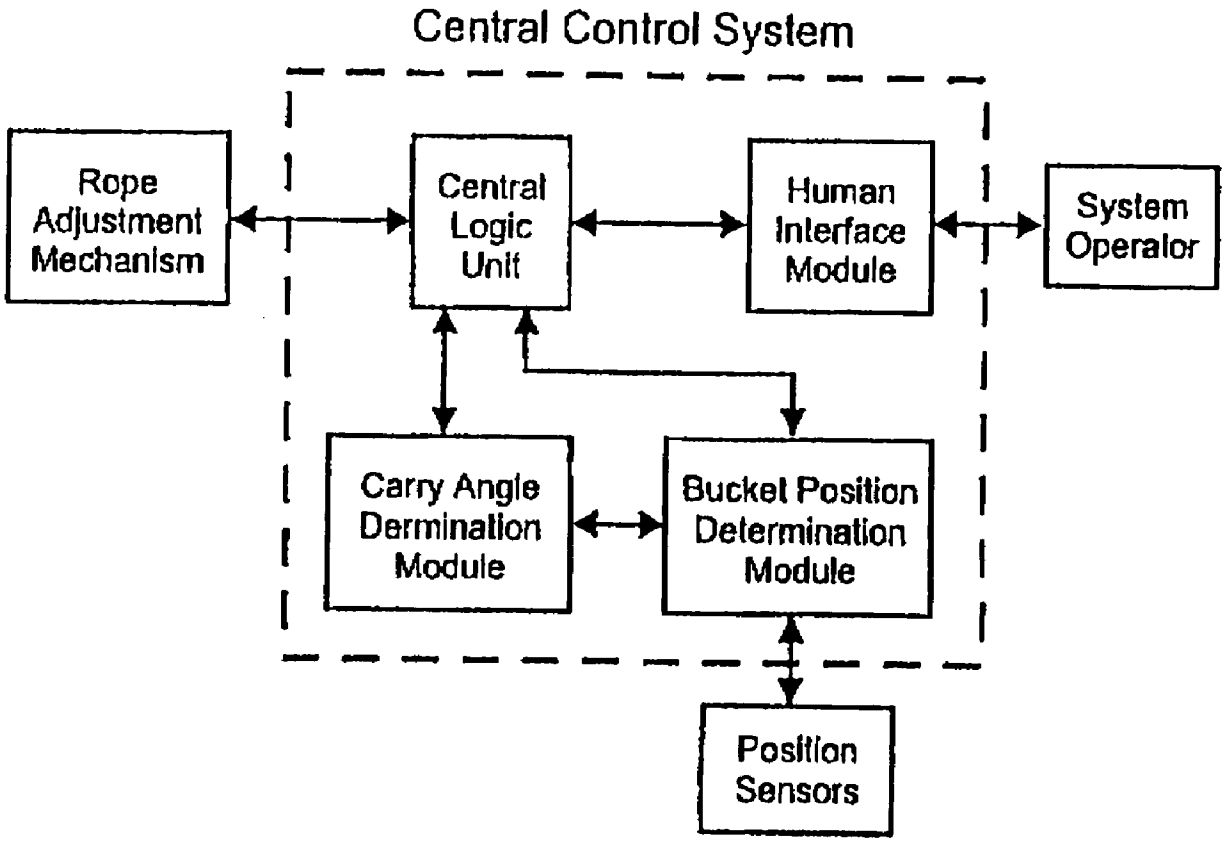

In a variation, the central control system can be configured to determine bucket carry angle without using a direct carry angle sensor. (See FIG. 8A). This is possible by determining the bucket's position using either direct lineal or remote sensors, and calculating the bucket's carry angle using trigonometric or kinematic techniques. The central logic unit can achieve this using direct analytical or empirical calculation methods. The current operational mode (e.g. chopping) and bucket position will determine what action the central control unit must take to allow the rope adjustment mechanism to achieve the desired bucket carry angle. Further, in one embodiment of the invention, the control of carry angle by the central control system can be minimised by using predetermined offset differences in hoist rope lengths throughout individual operational modes.

The central control system also determines the rates of dynamic transition that the rope adjustment mechanism may apply. These transitions may occur due to a change in operational mode (e.g. from carrying to dumping) or due to the necessity to maintain a constant carry angle from changing bucket position whilst in one operational mode (e.g. during hoisting). By controlling the rates at which these transitions occur, the magnitude of the dynamic loads imparted on the dragline can be, thus reducing the instance of mechanical failure.

Figure 9:
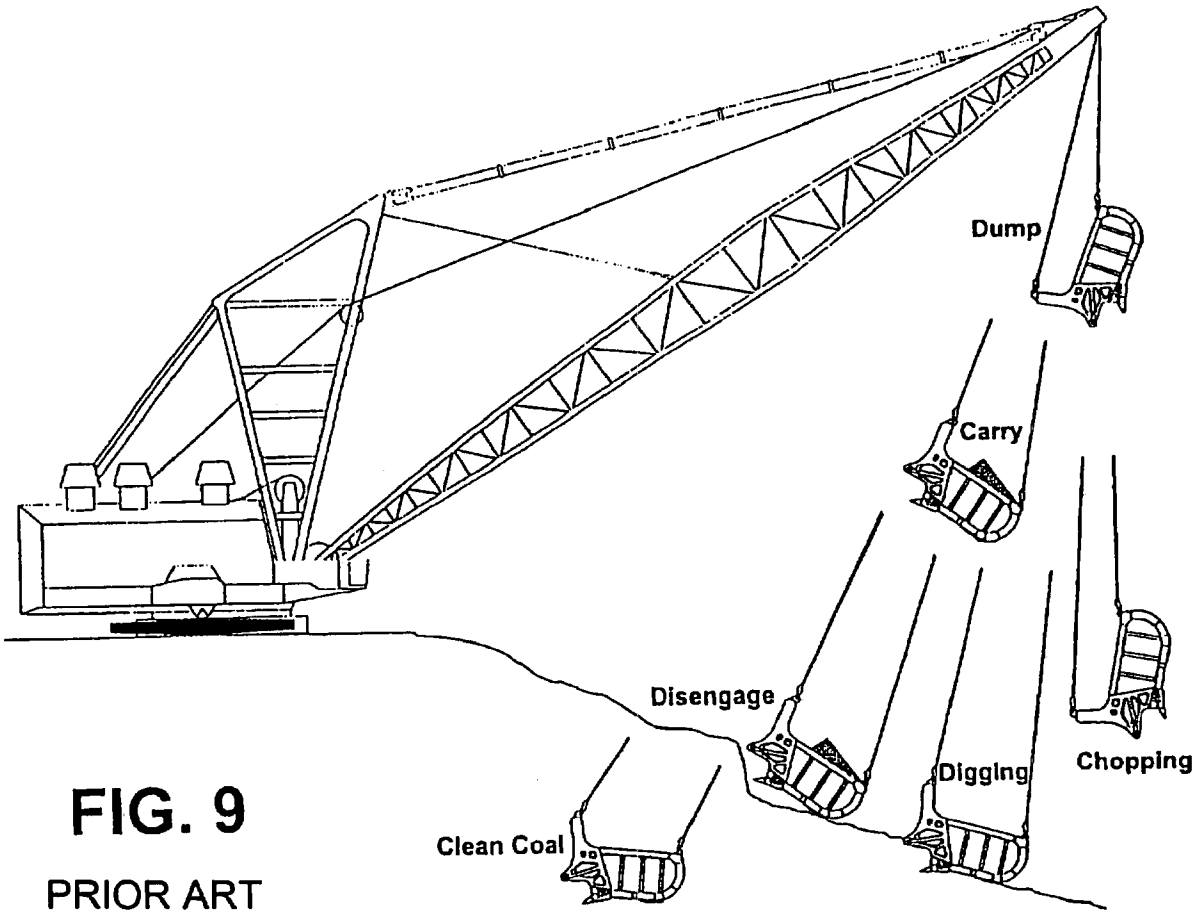
FIG. 9 PRIOR ART
FIG. 9 illustrates various operational modes.

The central logic unit takes the data from the carry angle determination module and instructions requested through the operator interface and ultimately actuates the rope control mechanism in a semi-automatic manner. The requests from the human interface module take the form of firstly, conventional operator signals, and secondly selection of an operational process or "mode". FIG. 9 illustrates some of the possible operational modes as would be understood by any person skilled in the art. These include:

a) Digging at any position under the boom b) Disengaging the bucket from the ground ready to be hoisted and/or swung c) Carrying d) Dumping e) Chopping f) Cleaning (top of coal if appropriate)

The central logic unit receives the request for a particular operational mode and alters the carry angle of the bucket appropriately via the rope adjustment system. Positive feedback from the bucket position and carry angle determination modules allow the central logic unit to continuously adjust the system to maintain the appropriate carry angle for the operational mode and operating conditions.

In addition, the central logic unit controls the rate at which various changes of mode are executed. For example, the dumping speed must be carefully controlled to minimise changes in loads imparted to the dragline structure.

In addition, the central control unit determines whether a particular mode or action is within the operational and safety constraints of the dragline. For example, if the operator sends a command that is in conflict with either the physical limitations or operational logic of the dragline.

The central control unit also records the history of bucket movements and predicts ahead the most likely immediate actions using empirical and analytical methods.

The human interface allows the operator to easily control the system. Selection of operational modes can be by direct switching in the operator's controls, joystick, keyboard input, touch screen, voice commands or any other convenient method. The human interface also allows the alteration of the software processes in the central logic unit. This may be for the purpose of manual override for fine tuning of the performance of a particular operation eg. to adjust the bucket angle during cleaning top of coal. The human interface also allows for the system to be halted in the event of an emergency.

Figure 8B:
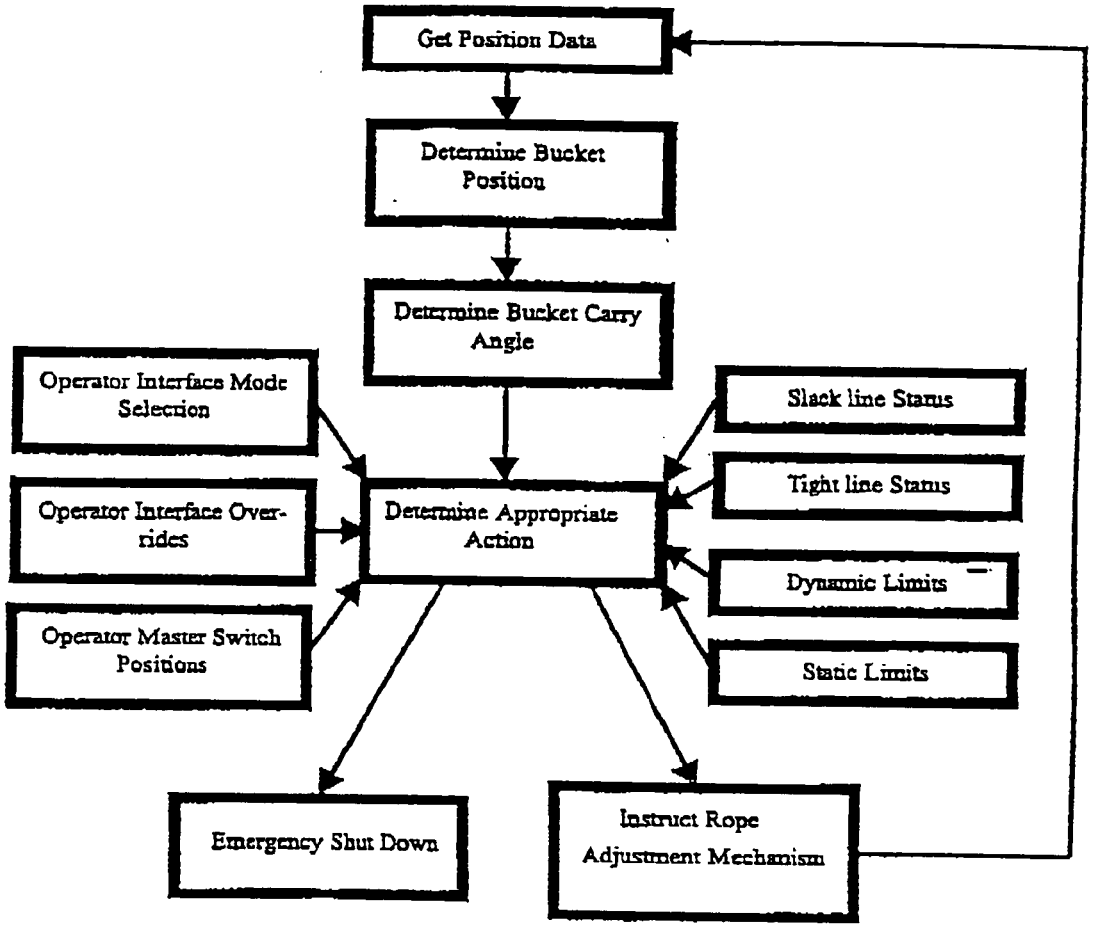
FIG. 8B illustrates the operating sequence under the control of the central control system and the operator.

The central control system's duties can be summarised into the following steps (see FIG. 8B)

1. Positional data is obtained from lineal sensors on the drag and hoist ropes
2. The bucket's position is determined by analytical and empirical techniques
3. The bucket's carry angle is determined by analytical and empirical techniques
4. Data is obtained via the operator interface to the status of mode selection
5. Data is obtained from the operator interface as to the status of over-rides
6. Data is obtained as to the current operator master switch (joystick) position
7. Data is obtained as to the status of hoist rope slack
8. Data is obtained as to the status of tight line conditions
9. Data is obtained as to dynamic limits 10. Data is obtained as to static limits
11. Action is determined using inputs from 3, 4, 5, 6, 7, 8, 9 and 10 using preset priority levels.
12. Normally, the rope adjustment mechanism will be instructed to alter the rope lengths according to the action determined in 11.
13. The action selected in 11 may be an emergency shutdown The duties of the central control system can be put into operation by a normal logic flow and command hierarchy set out below with reference to a system in which individual motors are used to control separate drums for the forward and rearward hoist ropes as previously described.

Inputs to Control Loop:

1. Selection of "Calibration" or "Run" mode (digital)

2. Calculated Bucket X-Y position (via rope length measurement)

3. Calculated Bucket Carry Angle (via analytical and empirical calculation)

4. Status (analogue or digital signal) of amount of slack line in both hoist ropes 5. Operator's Master-switch position (speed reference—analogue)

6. Operator's mode selection, eg. dig, carry, dump etc (digital)

7. Operator's override selection/status (analogue)

8. Hoist Motor status—"health", limit status etc.—(digital)

Logical Execution of Control Loop (in order of priority);

(1) If in "Calibration" mode, suspend all operations and proceed to calibration setup. If in "Run" mode, proceed to (2)
(2) Check safety status:
  (a) If approaching tightline envelope then reduce drag/hoist motor reference—goto (3*c*)
  (b) If in tightline, set brakes and disable normal operator control—goto emergency shutdown and tightline recovery procedure
  (c) If approaching bucket position limits, reduce relevant motor reference—goto (3*d*)
  (d) If past bucket position limits, set brakes and disable normal operator control—goto emergency shutdown and limits recovery procedure
  (e) If amount of slackline is above preset threshold, begin rope recovery (subject to (5))
  (f) If hoist motor status is "OK" goto (3). If not, determine fault code and if necessary goto emergency shutdown
(3) Calculate "target" bucket carry angle based on:
  (a) Current bucket position
  (b) Current Operator mode selection
  (c) Current Operator override status
(4) Calculate appropriate incremental adjustment in hoist rope length based upon results from (3), ad current dynamic and static limits.
(5) Check that new target carry angle and rope adjustment increment will not cause any safety violations (see (2)), and adjust if necessary
(6) If target carry angle is less than current calculated angle, instruct hoist rope drives to lengthen front rope with respect to rear by appropriate increment—goto (8)
(7) If target carry angle is greater than current calculated angle, instruct rope drives to shorten front rope with respect to rear by appropriate increment—goto (8)
(8) Goto (1)

In this manner the central control system not only enables the control of the dragline from one mode of operation to the next as has been previously proposed in the prior art such as Mitsubishi Australian patent specification 38089178 and Winders, Barlow and Morrison Australian patent specification 28179/84, but which also enables the control system to maintain the bucket in a desired angle of inclination for operation during the mode of dragline operation selected by the operator. The control system is therefore able to continuously achieve the optimum digging angle or carry angle during all phases of the digging or carrying operation, or to orientate the bucket in the optimum chopping angle or dumping angle during the corresponding selected phases of operation. This gives significant increases in operating efficiency due to decreased cycle time and increased pay load for each cycle of operation.

The invention provides many advantages not hitherto realised, including:

The suspension system eliminates the need for the following rigging components: hoist equaliser, miracle hitch, upper hoist chains, lower hoist chains, spreader bar, hoist trunnions, hoist trunnion deflectors, dump rope, dump block and dump chains.

The weight eliminated from the rigging system can be directly replaced by bucket payload without exceeding the Rated Suspended Load of the dragline, hence increasing productivity. A further result is that maintenance costs and delays are substantially reduced.

The suspension system increases the maximum height to which a dragline bucket can be hoisted because the direct connection of the rear hoist cable to the bucket can be retrieved almost completely to the boom point sheaves rather than to the top of conventional bucket rigging.

The suspension system enables the bucket to be hoisted immediately after it has been filled rather than over dragged to a point close enough to the dragline support where the dump rope tension is sufficient to raise the front of the bucket. A further result is that early bucket pick up improves the hoist geometry, i.e. the hoist ropes are more vertical.

By repositioning the boom point sheaves to be one in front of the other rather than side by side, the hoist rope loads are substantially reduced when the bucket approaches the boom and/or boom point sheaves, and the chopping or dumping reach of the dragline is significantly increased without increasing the maximum loads on the structure.

Furthermore, spacing the boom point sheaves by a fixed distance of similar order to the spacing of the hoist rope connections to the bucket, minimises the amount of differential hoist rope control necessary to maintain optimum carry angle, particularly in digging, carrying, and cleaning modes.

The carry angle during chopping or dumping may be improved by repositioning the rear hoist rope attachment point to different sites on the bucket.

A control system can be used that allows the carry angle of the bucket to be continuously varied to suit all aspects of dragline operations and conditions. The control system allows an operator to select any operational mode including dig, disengage, carry, dump, chop and cleaning top of coal. The control system automatically optimises the carry angle of the bucket for any of the operational modes by acing a hoist rope length alteration system. As a result, the dynamic loads on the dragline are substantially reduced because the execution of the dynamic operations (such as bucket dumping) are controlled by a computer rather than a human operator. The control system allows the optimisation of bucket payload by altering bucket carry angle for different conditions such as digging material properties. The control system reduces the risk of the dragline being operated in such a way as to damage the machine or cause injury to personnel. The actions are achieved by the control system using empirical and analytical techniques with direct, indirect and remote sensing input data to calculate bucket position and carry angle. The control system allows for manual override of functions and a facility for emergency shutdown. The control system allows the operator to issue commands to the system in a simple manner that requires a minimum of retraining.

A slack rope control system ensures the correct spooling of ropes onto the hoist drum.

The automatic control of bucket carry angle during the action of cleaning top of coal substantially reduces coal losses.

The suspension system allows the dragline bucket to dump payload at a position up to two thirds of the total boom point radius, inside of boom point.

The invention claimed is:

1. A large electric dragline of the type typically used for open cut mining operations comprising:

a rotatable support mounted on a base;

a boom assembly projecting outwardly from the support and rotatable therewith;

a bucket suspended from a distal end of the boom assembly by adjustable hoist ropes and controllable by at least one adjustable drag rope extending from the support to the bucket;

a rigging configuration providing first and second boom point sheaves located at or adjacent the distal end of the boom assembly and spaced apart one behind the other by a fixed distance such that the first sheave is located closer to the support than the second sheave;

first and second hoist ropes entrained over the first and second boom point sheaves, the first hoist rope being entrained over the first sheave, extending downwardly and being operatively connected solely to a front section of the bucket, the second hoist rope being entrained over the second sheave, extending downwardly and being operatively connected to a rear section of the bucket; and a control system using a computer to control the relative movement of the first and second hoist ropes via hoisting gear arranged to alter the angle of inclination of the bucket in a vertical plane by differential movement of one hoist rope relative to the other, to maintain the bucket in a desired angle of inclination for a mode of dragline operation selected by an operator.

2. A rigging configuration for a dragline having a rotatable support mounted on a base, a boom assembly projecting outwardly from the support and rotatable therewith, and a bucket suspended from a distal end of the boom assembly by adjustable hoist ropes and controllable by at least one adjustable drag rope extending from the support to the bucket, the rigging configuration providing at least first and second boom point sheaves located at or adjacent the distal end of the boom assembly and spaced apart one behind the other by a fixed distance such that the first sheave is located closer to the support than the second sheave, first and second hoist ropes entrained over the first and second boom point sheaves, one to each, the first hoist rope being entrained over the first sheave, extending downwardly and being operatively connected solely to a front section of the bucket, the second hoist rope being entrained over the second sheave, extending downwardly and being operatively connected to a rear section of the bucket, and the at least one drag rope extending from the support and being operatively connected to the front section of the bucket.

3. A rigging configuration for a dragline as claimed in claim 2, wherein the first and second sheaves are spaced apart by a fixed distance of a similar order to the spacing of the operative connections of the first and second hoist ropes to the bucket.

4. A rigging configuration for a dragline as claimed in claim 2, wherein the first and second sheaves each have a medial plane extending from the mid point of the sheave perpendicular to the axis of rotation of that sheave, and wherein the medial planes the first and second sheaves lie substantially in a common vertical plane.

5. A dragline mining apparatus comprising:

a rotatable support mounted on a base;

a boom assembly projecting outwardly from the support and rotatable therewith the boom assembly having a boom having a length of about 100 meters;

a bucket having a pay load capacity of about 90 tons and being suspended from the boom assembly by adjustable hoist ropes and controllable by at least one adjustable drag rope extending from the support to the bucket; and the rigging configuration of claim 1.

6. A dragline mining apparatus for open cut mining operations comprising:

a rotatable support mounted on a base;

a boom assembly projecting outward from the support and rotatable therewith;

a bucket suspended from a distal end of the boom assembly by adjustable hoist ropes and controllable by at least one drag rope extending from the support to the bucket;

the rigging configuration of claim 1; and a control system using a computer to control the relative movement of the first and second hoist ropes via hoisting gear arranged to alter the angle of inclination of the bucket in a vertical plane by differential movement of one hoist rope relative to the other, to maintain the bucket in a desired angle of inclination for a mode of dragline operation selected by an operator.

7. A dragline having a rigging configuration as claimed in claim 2 and further incorporating differential control for hoist rope payout and retrieval, arranged such that the length of one said hoist rope may be adjusted relative to the other said hoist rope to control the angle of inclination of the bucket in a vertical plane.

8. A dragline as claimed in claim 7 wherein one said hoist rope is wound on to a first drum located on the base, and the other said hoist rope is wound on to a second drum located on the base, the first and second drums being independently rotatable to achieve said differential control.

9. A dragline as claimed in claim 8 wherein said first and second drums are mounted adjacent one another on a common axis with their inner ends adjacent to one another.

10. A rigging configuration for a dragline as claimed in claim 2 wherein the first hoist rope is connected directly to an upper portion of the front section of the bucket, and the second hoist rope is connected directly to the rear section of the bucket, the at least one dragline being connected to the bucket at a position that is below and independent of the first hoist rope.

11. A rigging configuration for a dragline as claimed in claim 10 wherein the first hoist rope is connected to the mid point of an arch extending across the mouth of the bucket.

12. A rigging configuration for a dragline as claimed in claim 10 wherein the second hoist rope is connected to a top rail extending across a rear wall of the bucket.

13. A rigging configuration for a dragline as claimed in claim 10 wherein the second hoist rope is connected to the rear wall of the bucket at a point between the top rail of the rear wall and the base of the bucket, said point being located significantly below the top rail.

14. A control system for a dragline of the type having a rotatable support mounted on a base, a boom assembly projecting outwardly from the support and rotatable therewith, and a bucket suspended from a distal end of the boom assembly by adjustable hoist ropes and controllable by at least one adjustable drag rope extending from the support to the bucket, there being at least two adjustable hoist ropes of which the first is operatively connected to a front section of the bucket and the second is operatively connected to a rear section of the bucket, each hoist rope being actuated by hoisting gear arranged to alter the angle of inclination of the bucket in a vertical plane by differential movement of one hoist rope relative to the other, the control system using a computer to control the relative movement of the first and second hoist ropes via the hoisting gear, to maintain the bucket in a desired angle of inclination for a mode of dragline operation selected by an operator, wherein the dragline includes at least first and second boom point sheaves located at or near the distal end of the boom assembly, spaced apart one behind the other by a fixed distance such that the first sheave is located closer to the support relative to the second sheave, the first said hoist rope being entrained over the first sheave and the second said hoist rope being entrained over the second sheave.

15. A control system for a dragline as claimed in claim 14 wherein the modes of dragline operation selected by the operator can include any one or more of chopping, digging, disengaging, carrying, dumping and cleaning modes.

16. A dragline mining apparatus comprising:

a rotatable support mounted on a base;

a boom assembly projecting outwardly from the support and rotatable therewith, said boom assembly having a length of about 100 meters;

a bucket having a payload capacity of about 90 tons and being suspended from the boom assembly by adjustable hoist ropes and controllable by at least one adjustable drag rope extending from the support to the bucket; and the control system of claim 14.

17. A control system for a dragline as claimed in claim 14 wherein, in one or more of the selected modes of operation, the computer controls the desired angle of operation continuously throughout that mode.

18. A control system for a dragline as claimed in claim 17 wherein said one or more selected modes of operation comprises multiple modes including digging, carrying, and cleaning modes.

19. A control system for a dragline as claimed in claim 14 wherein the computer is used to limit the rates of dynamic transition that the hoisting gear may apply.

20. A control system for a dragline as claimed in claim 19 wherein the dynamic transition occurs during a change in the mode of operation.

21. A control system for a dragline as claimed in claim 14 wherein the control system is arranged to allow the operator to control movement of the bucket relative to the boom assembly and housing.

22. A control system for a dragline as claimed in claim 21 wherein the control system is arranged to allow the operator to control movement of the bucket relative to the boom assembly and housing only within preset safe operating parameters.

23. A rigging configuration for a dragline having a rotatable support mounted on a base, a boom assembly projecting outwardly from the support and rotatable therewith, and a bucket suspended from the boom assembly by adjustable hoist ropes and controllable by at least one adjustable drag rope extending from the support to the bucket, the rigging configuration providing at least first and second boom point sheaves located at or adjacent the distal end of the boom assembly and spaced apart one behind the other by a fixed distance such that the first sheave is located closer to the support than the second sheave, first and second hoist ropes entrained over the first and second boom point sheaves, one to each, the first hoist rope being entrained over the first sheave, extending downwardly and being operatively connected to a front section of the bucket, the second hoist rope being entrained over the second sheave, extending downwardly and being operatively connected to a rear section of the bucket, such that in use, orientation of the bucket in a vertical plane can be controlled to maintain the bucket in a desired angle of inclination for a mode of dragline operation selected by an operator, and the at least one drag rope extending from the support and being operatively connected to the front section of the bucket.

24. A rigging configuration for a dragline as claimed in claim 23, wherein the first and second sheaves are spaced apart one behind the other by a fixed distance of a similar order to the spacing of the operative connections of the first and second hoist ropes to the bucket.

25. A rigging configuration for a dragline as claimed in claim 23, wherein the first and second sheaves each have a medial plane extending from the mid point of the sheave perpendicular to the axis of rotation of that sheave, and wherein the medial planes the first and second sheaves lie substantially in a common vertical plane.

26. A rigging configuration for a dragline as claimed in claim 23 wherein the first hoist rope is connected directly to a front section of the bucket, and the second hoist rope is connected directly to a rear section of the bucket, without the use of intervening rigging such as spreader bars or trunnions.

27. A rigging configuration for a dragline as claimed in claim 26 wherein the second hoist rope is connected to the rear wall of the bucket at a point between the top rail of the rear wall and the base of the bucket, said point being located significantly below the top rail.

28. A dragline mining apparatus comprising:

a rotatable support mounted on a base;

a boom assembly projecting outwardly from the support and rotatable therewith;

a bucket suspended from the boom assembly by adjustable hoist ropes and controllable by at least one adjustable drag rope extending from the support to the bucket; and the rigging configuration of claim 23.

29. A dragline having a rigging configuration as claimed in claim 23 and further incorporating differential control for hoist rope payout and retrieval, arranged such that the length of one said hoist rope may be adjusted relative to the other to control the angle of inclination of the bucket in a vertical plane.

30. A dragline as claimed in claim 29 wherein one said hoist rope is wound on to a first drum located on the base, and the other said hoist rope is wound on to a second drum located on the base, the first and second drums being independently rotatable to achieve said differential control.

31. A dragline as claimed in claim 30 wherein said first and second drums are mounted adjacent one another on a common axis with their inner ends adjacent to one another.

32. A rigging configuration for a dragline as claimed in claim 26 wherein the first hoist rope is connected to the mid point of an arch extending across the mouth of the bucket.

33. A rigging configuration for a dragline as claimed in claim 26 wherein the second hoist rope is connected to a top rail extending across a rear wall of the bucket.

* * * * *